US008505530B2

(12) United States Patent
Robison et al.

(10) Patent No.: US 8,505,530 B2
(45) Date of Patent: Aug. 13, 2013

(54) COMMERCIAL KITCHEN EXHAUST SYSTEM

(75) Inventors: Russell Robison, Yamhill, OR (US); Kui-Chiu Kwok, Gurnee, IL (US); Bruce Lukens, Newberg, OR (US)

(73) Assignee: ITW Food Equipment Group LLC, Glenview, IL (US)

( * ) Notice: Subject to any disclaimer, the term of this patent is extended or adjusted under 35 U.S.C. 154(b) by 375 days.

(21) Appl. No.: 12/622,070

(22) Filed: Nov. 19, 2009

(65) Prior Publication Data

US 2011/0114076 A1 May 19, 2011

(51) Int. Cl.
*F24C 15/20* (2006.01)

(52) U.S. Cl.
USPC ..... 126/299 R; 126/299 F; 126/300; 454/56

(58) Field of Classification Search
USPC ..... 126/299 D, 299 R, 299 F, 300; 454/56
See application file for complete search history.

(56) References Cited

U.S. PATENT DOCUMENTS

| | | | | | |
|---|---|---|---|---|---|
| 2,535,863 | A | * | 12/1950 | Pledger | 126/301 |
| 2,577,150 | A | * | 12/1951 | Pledger | 126/299 R |
| 2,746,449 | A | * | 5/1956 | Pledger | 126/301 |
| 2,868,108 | A | * | 1/1959 | Petersen | 126/299 D |
| 3,645,194 | A | * | 2/1972 | Ahlrich | 126/299 D |
| 3,664,255 | A | | 5/1972 | Kuechler | |
| 3,800,689 | A | | 4/1974 | Brown | |
| 3,870,494 | A | * | 3/1975 | Doane | 55/443 |
| 3,943,836 | A | * | 3/1976 | Kuechler | 126/299 D |
| 3,945,812 | A | * | 3/1976 | Doane | 95/272 |
| 3,952,640 | A | * | 4/1976 | Kuechler | 126/299 D |
| 4,011,802 | A | * | 3/1977 | Molitor et al. | 126/299 R |
| 4,043,319 | A | * | 8/1977 | Jensen | 126/299 D |
| 4,047,519 | A | * | 9/1977 | Nett | 126/299 D |
| 4,089,327 | A | | 5/1978 | Welsh | |
| 4,141,342 | A | * | 2/1979 | Kuechler | 126/299 D |
| 4,143,645 | A | * | 3/1979 | Blumberg | 126/299 D |
| 4,186,727 | A | | 2/1980 | Kaufman et al. | |

(Continued)

FOREIGN PATENT DOCUMENTS

| | | |
|---|---|---|
| CN | 201314614 | 9/2009 |
| DE | 3144777 | 5/1983 |
| DE | 10203650 | 4/2004 |
| EP | 0667493 | 8/1995 |

OTHER PUBLICATIONS

Armin Rudd; Design Process for Sizing: Cooling and Heating System Capacity, Room Air Flows, Trunk and Runout Ducts, and Transfer Air Ducts; Dec. 19, 2006; Building Science Corporation; p. 8.*

(Continued)

*Primary Examiner* — Kenneth Rinehart
*Assistant Examiner* — Jorge Pereiro
(74) *Attorney, Agent, or Firm* — Thompson Hine LLP

(57) ABSTRACT

An exhaust system includes a hood structure having one or more of (i) an exhaust flow infeed surface extending downward from a lower end of the filter unit that helps to feed the thermal plume toward the filter unit, (ii) a bypass flow transition surface extending upward from the upper end of the filter unit and then forward to aid bypass flow in circulating back toward the filter aperture and (iii) a front wall structure that includes a downwardly extending wall portion with a chamfered and/or curved transition portion at its lower end and a rearwardly extending wall portion.

5 Claims, 8 Drawing Sheets

(56) References Cited

U.S. PATENT DOCUMENTS

| | | | | | |
|---|---|---|---|---|---|
| 4,200,087 | A | * | 4/1980 | Welsh | 126/299 R |
| 4,250,870 | A | * | 2/1981 | Kuechler | 126/299 D |
| 4,266,528 | A | * | 5/1981 | Barnhart et al. | 126/299 D |
| 4,346,692 | A | * | 8/1982 | McCauley | 126/299 D |
| 4,475,534 | A | | 10/1984 | Moriarty | |
| 4,483,316 | A | * | 11/1984 | Fritz et al. | 126/299 D |
| 4,484,563 | A | * | 11/1984 | Fritz et al. | 126/299 D |
| 4,493,312 | A | * | 1/1985 | Moon | 126/299 D |
| 4,586,486 | A | | 5/1986 | Kaufman | |
| 4,822,385 | A | * | 4/1989 | Strege et al. | 96/334 |
| 5,050,581 | A | * | 9/1991 | Rohl-Hager et al. | 126/299 D |
| 5,063,906 | A | | 11/1991 | Rogers et al. | |
| 5,154,161 | A | | 10/1992 | Rogers et al. | |
| 5,251,608 | A | | 10/1993 | Cote | |
| 5,359,990 | A | * | 11/1994 | Hsu | 126/299 E |
| 5,467,761 | A | * | 11/1995 | Kuechler | 126/299 D |
| 5,472,342 | A | * | 12/1995 | Welsh et al. | 126/299 E |
| 5,577,490 | A | | 11/1996 | Overton, Jr. | |
| 5,713,346 | A | * | 2/1998 | Kuechler | 126/299 D |
| 5,906,195 | A | * | 5/1999 | Georgaras | 126/299 D |
| 6,196,214 | B1 | | 3/2001 | Van Niekerk | |
| 6,443,144 | B1 | | 9/2002 | Van Niekerk | |
| 6,712,068 | B1 | | 3/2004 | Yeung | |
| 6,802,767 | B2 | * | 10/2004 | Kanaya | 454/49 |
| 2004/0110458 | A1 | * | 6/2004 | Kato et al. | 454/1 |
| 2004/0129263 | A1 | | 7/2004 | Chiang et al. | |
| 2006/0005828 | A1 | * | 1/2006 | Musico | 126/299 D |
| 2006/0032492 | A1 | * | 2/2006 | Bagwell et al. | 126/299 R |
| 2006/0060187 | A1 | | 3/2006 | Luddy et al. | |
| 2006/0154590 | A1 | * | 7/2006 | Kanaya | 454/56 |
| 2006/0213501 | A1 | * | 9/2006 | Musico | 126/290 |
| 2008/0121224 | A1 | * | 5/2008 | Giles | 126/299 R |
| 2008/0308088 | A1 | * | 12/2008 | Livchak et al. | 126/299 R |
| 2009/0032011 | A1 | * | 2/2009 | Livchak et al. | 126/299 D |
| 2010/0126494 | A1 | * | 5/2010 | Lambertson | 126/299 D |

OTHER PUBLICATIONS

PCT, International Search Report and Written Opinion, International Application No. PCT/US2010/055347 (Mar. 30, 2011).

* cited by examiner

COMMERCIAL KITCHEN EXHAUST SYSTEM

TECHNICAL FIELD

The present invention relates generally to exhaust hoods utilized in kitchens of commercial establishments such as restaurants and cafeterias and, more particularly, to an exhaust hood structure and arrangement that effectively removes a thermal plume generated by commercial cooking equipment with a reduced exhaust volume.

BACKGROUND

Kitchen ventilator exhaust hoods have long been provided for the purpose of exhausting steam, smoke, heat and effluent particulates such as grease (e.g., generally referred to as the thermal plume) that are produced by cooking appliances in the commercial cooking environment. A variety of exhaust hood configurations are known. A typical hood system configuration is depicted in FIG. 1, where an apron 10 of the hood 12 forces the buoyancy driven exhaust flows to change direction resulting in lateral flows proximate the filter aperture such that increased exhaust airflow rates are required to maintain the capture and containment of flows. The filter aperture 14 and filter unit 16 are angled at approximately 45 degrees or greater to vertical, and the thermal plume and replacement air are shown respectively by flows 18 and 20. Notably, the replacement air flow includes a significant component that travels between the rear side of the commercial cooking appliances 22 (e.g., ranges, broilers, frying apparatus etc.) and the building wall structure 24. In order to assure the capture of substantially all of the thermal plume, existing hood systems typically draw off and expel an undesirably large volume of air.

SUMMARY

An exhaust system includes a hood structure having one or more of (i) an exhaust flow infeed surface extending downward from a lower end of the filter unit that helps to feed the thermal plume toward the filter unit, (ii) a bypass flow transition surface extending upward from the upper end of the filter unit and then forward to aid bypass flow in circulating back toward the filter aperture and (iii) a front wall structure that includes a downwardly extending wall portion with a chamfered and/or curved transition portion at its lower end and a rearwardly extending wall portion.

In one aspect, a commercial cooking equipment exhaust system for exhausting thermal plume produced by cooking operations includes a hood structure with a downwardly facing inlet opening, a filter aperture positioned within the hood structure with a filter unit positioned therein. An exhaust flow infeed surface extends downward from a lower end of the filter unit, the exhaust flow infeed surface oriented at an angle of no more than forty degrees relative to a laterally extending plane that is arranged perpendicular to an inlet face of the filter unit.

In another aspect, a commercial cooking equipment exhaust system for exhausting thermal plume produced by cooking operations includes a hood structure with a downwardly facing inlet opening, a filter aperture positioned within the hood structure with a filter unit positioned therein, the filter aperture arranged such that an inlet face of the filter is arranged at an angle that is at least fifty degrees offset from vertical. An exhaust flow infeed surface extending downward from a lower end of the filter unit and below a lower edge of the hood structure for guiding thermal plume flows into the filter unit.

In a further aspect, A commercial cooking equipment exhaust system for exhausting thermal plume produced by cooking operations includes a hood structure with a downwardly facing inlet opening, a filter aperture positioned within the hood structure with a filter unit positioned therein. A bypass flow transition surface extends upward from the upper end of the filter unit and then forward toward a front of the hood structure to aid bypass flow in circulating back toward the filter aperture.

DESCRIPTION

Figure 2:
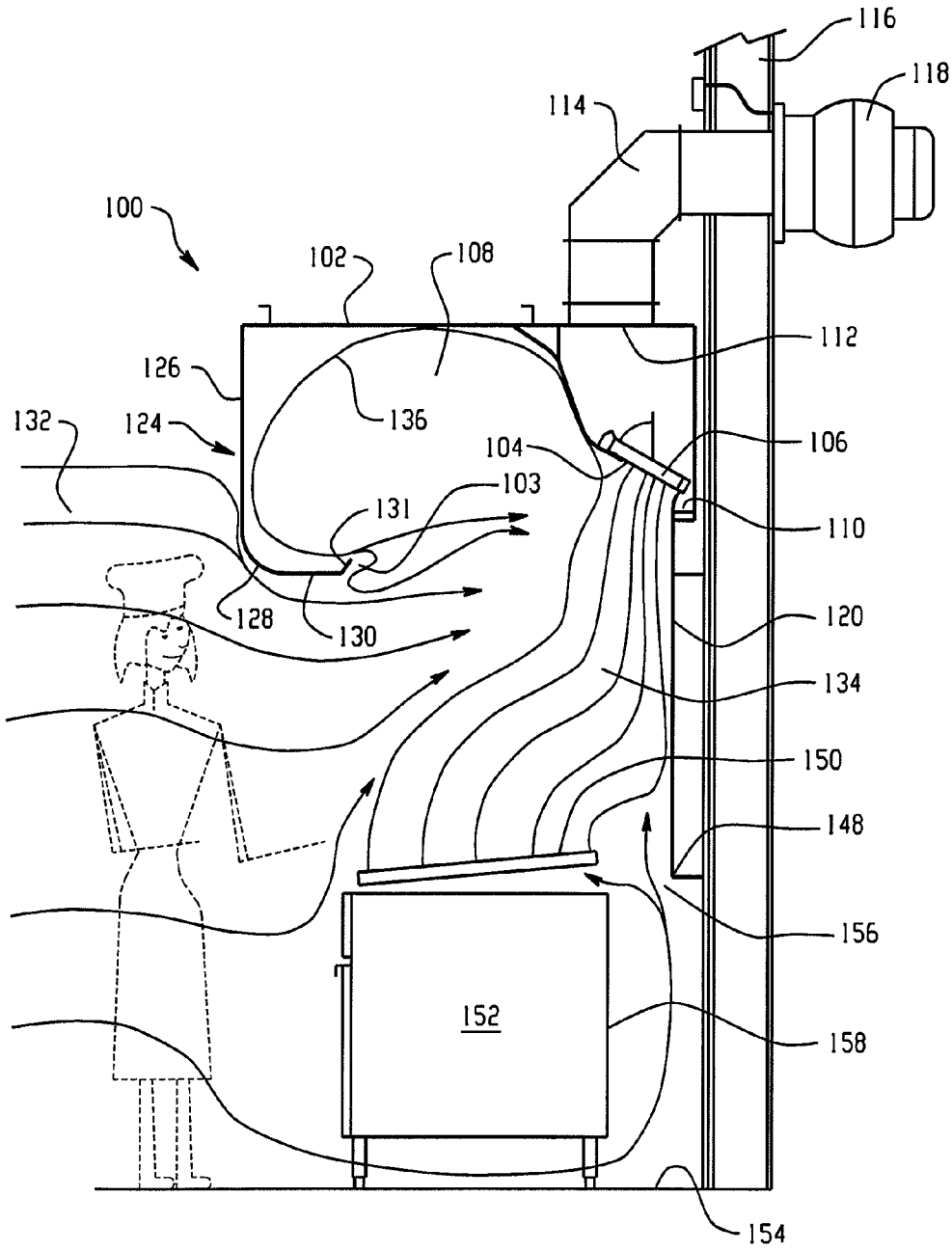
FIG. 2 is a side elevation of one embodiment of an exhaust hood system according to the present application.

Referring to FIG. 2, a side elevation of a commercial cooking equipment exhaust system 100 is shown. The system includes a hood structure 102 having a downwardly facing inlet, opening 103 and a filter aperture 104 with a filter unit 106 positioned therein. The filter unit may typically be formed by a baffle-type filter, but other types of filter structures could be used. The filter aperture 104 and filter unit 106 are located toward the rear side of the hood structure 102. Upstream and forward of the filter aperture the hood structure 102 defines a containment and capture volume 108 for flows that bypass the filter. Downstream of the filter aperture the hood structure may include a grease gutter 110 and an exhaust outlet 112 that connects with ductwork 114 that, in the illustrated embodiment, passes through a building wail structure 116, and has an associated exhaust fan 118. The operation of the exhaust fan pulls air through the filter unit 106. In other embodiments, additional baffling or other structure (e.g., spray cleaning systems and/or fire suppression systems) may be located with the hood structure. The primary components of the hood structure may, typically, be manufactured of sheet metal type material, such as stainless steel. The hood structure may typically be mounted to and supported by the building wail structure and/or a ceiling structure of the installation site.

Notably, the illustrated hood structure includes an exhaust flow infeed surface 120 extending downward from a lower end of the filter unit 106 that helps to feed the thermal plume toward the filter unit, a bypass flow transition surface 122 extending upward from the upper end of the filter unit 106 and then forward to aid bypass flow in circulating back toward the filter aperture and a front wall structure 124 that includes a downwardly extending wall portion 126 with a chamfered and/or curved transition portion 128 at its lower end and a rearwardly extending wall portion 130 that promotes a horizontal component in replacement air flow. The replacement air flow is represented by flow 132, thermal plume flow is represented by flow 134 and filter bypass flow is represented by flow 136.

Figure 3:
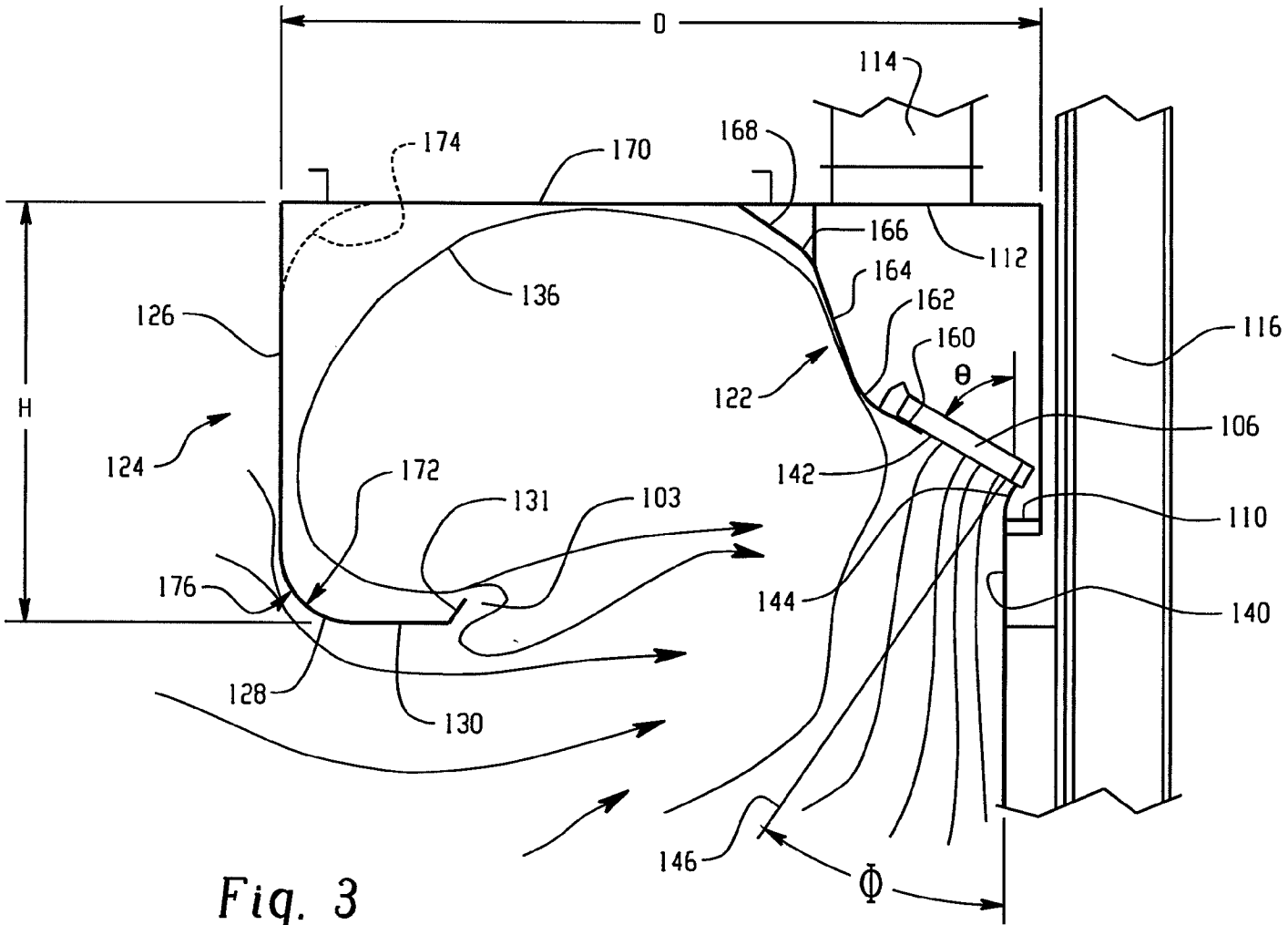
FIG. 3 is an enlarged partial side elevation of the system of FIG. 2.
Figure 4:
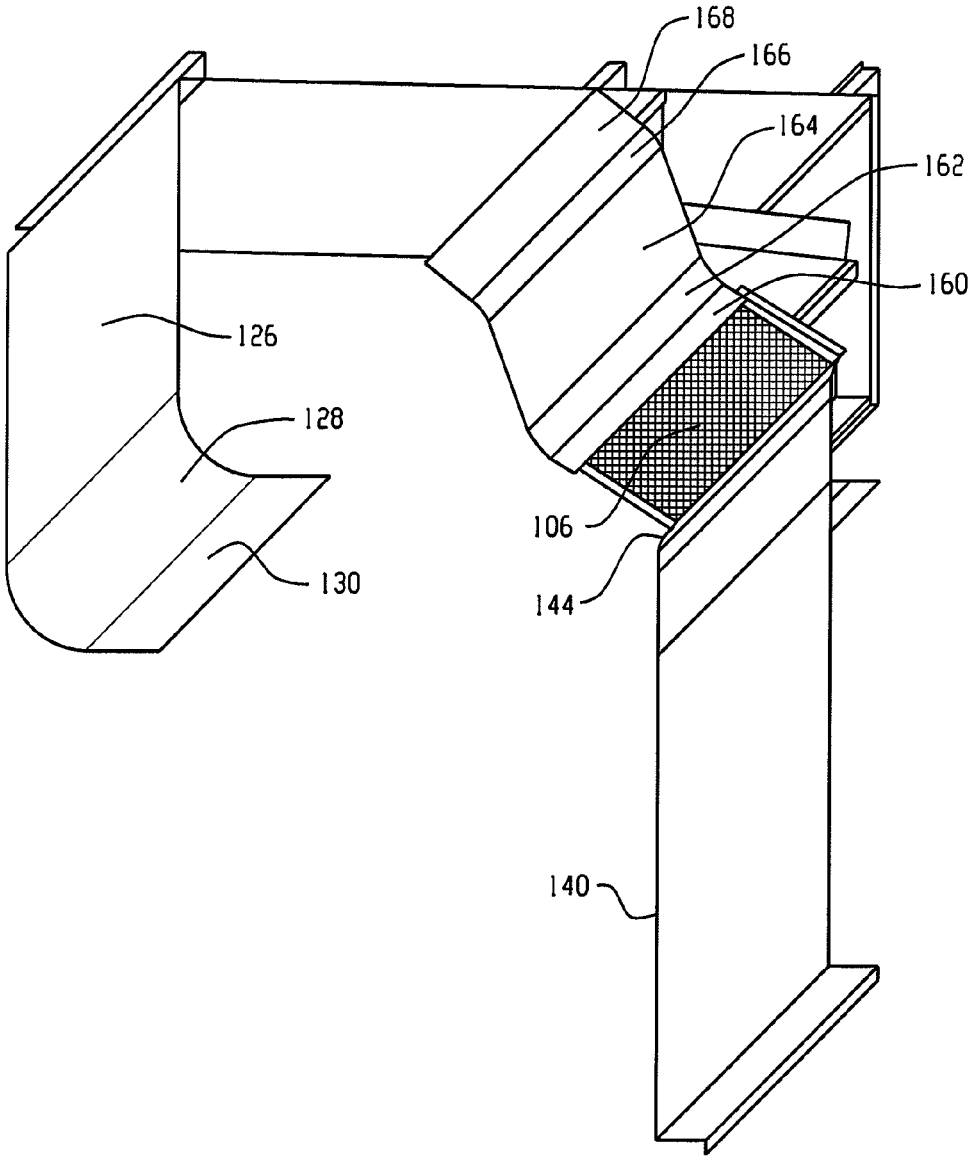
FIG. 4 is a partial perspective of the system of FIG. 2.

Referring to the enlarged partial side elevation view of FIG. 3 and the partial perspective view of FIG. 4, the exhaust flow infeed surface includes a major portion 140 that is arranged substantially vertically. The inlet face 142 of the filter unit is arranged at an angle θ relative to vertical of at least fifty degrees, and preferably at least fifty-five degrees or more preferably at least sixty degrees. An upper, minor portion 144 of the exhaust flow infeed surface turns rearward from the top of the major portion 140 and terminates proximate a lower end of the filter unit 106. This arrangement results in an exhaust flow infeed surface that is oriented at an angle Φ of no more than forty-five degrees, and preferably no more than forty degrees, and more preferably no more than thirty-five degrees (e.g., thirty degrees or less) relative to a laterally extending plane 146 (extending into and out of the page in the side view of FIG. 3) that is arranged perpendicular to the inlet face 142 of the filter unit, thereby resulting in a plume flow that moves toward and into the inlet filter as a similar angle. Notably, as shown, the plume flow is thus directed into the filter unit without any required change of direction in the vicinity of the hood structure, which change of direction would tend to interfere with a free flow into and through the filter unit. The more perpendicular the inflow is to the inlet face of the filter, the greater the free flow into and through the filter unit.

Referring to FIGS. 2 and 4, the exhaust flow infeed surface extends downward below the hood and terminates with its a lower end at a height that is proximate a height of the cooking surface 150 of the commercial cooking appliance 152. Typically, this height should be at least thirty inches above the floor (e.g., between 32 and 44 inches above the floor 154) as dictated by equipment heights and associated utility hook ups. The exhaust flow infeed surface 120 is offset outward from the building wall structure 116, pinching off and reducing the size of the flow area 156 for replacement air that travels beneath the appliance and upward along the rear side 158 of the appliance. This configuration enhances the thermal plume's tendency to attach to and travel along the surface 120 due to the Coanda effect. Typically, the surface 120 may be offset from the wall surface by a distance of at least 3 inches (e.g., between 3 and 16 inches), and the rear side 158 of the appliance may be offset from the wall surface by at least 4 inches (e.g., between 4 and 17 inches). The exhaust flow infeed surface 120 may be formed by, for example, a box-like structure formed of sheet metal that is enclosed at the sides and the bottom (e.g., the space behind the surface is not used for the flow of air into the hood or back into the kitchen).

As shown in FIG. 3, the bypass flow transition surface 122 extends upward from the upper end of the filter unit and then forward toward the front of the hood structure to aid bypass flow in circulating back toward the filter aperture. In the commercial cooking environment the volume of the thermal plume can vary significantly and, at peak thermal plume production, the flow through the filter unit is not sufficient to draw in the entire thermal plume volume, which results in a bypass flow 136 past the filter unit, which is allowed to accumulate in the front of the hood until plume generation slows. The surface 122 includes a first portion 160 that extends away from the upper end of the filter unit and generally parallel to the inlet face of the filter unit, a second portion 162 that turns (e.g., via curving and/or chamfering) upward to a third, generally planar portion 164 that is angled upward relative to the plane in which the inlet face of the filter unit lies, followed by a fourth portion 166 that turns (e.g., via curving and/or chamfering) forward to a fifth portion 168 that intersects with the top wall 170 of the hood structure. The surface 122, which is multi faceted, and shaped to create a convex radius shape, serves to accelerate the flow bypassing the filter towards the top panel of the hood and then to the front of the hood.

Figure 1:
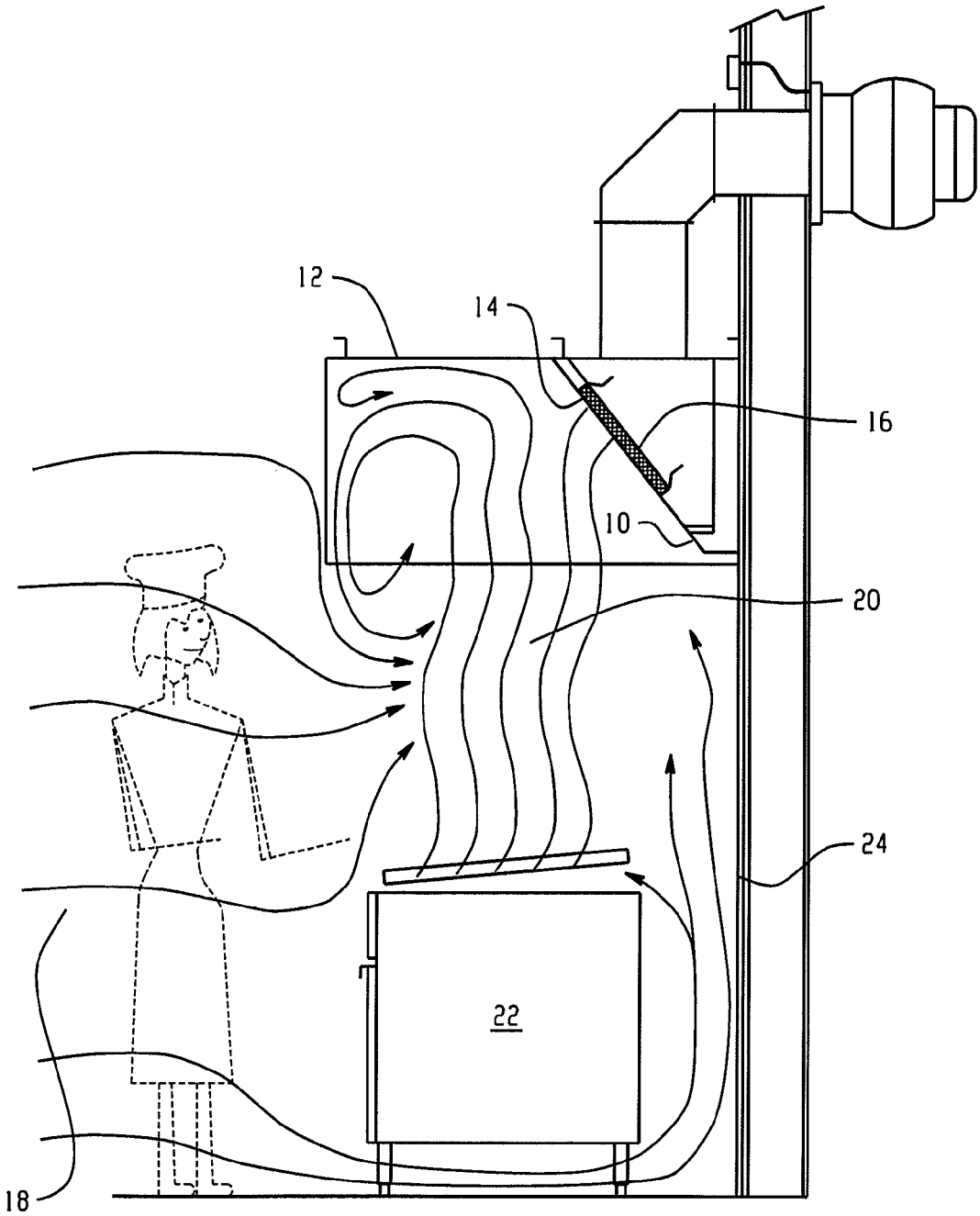
Fig. 1 PRIOR ART
FIG. 1 is a side elevation of a prior art exhaust hood system.

In this regard, the front 124 of the hood structure includes downwardly extending wall portion 126 with a chamfered and/or curved transition portion 128 at its lower end and a rearwardly extending wall portion 130 that is generally horizontal. The front wall structure provides an interior chamfered and/or curved transition surface 172 that aids in turning the bypass flow back toward the filter. Likewise, the horizontal extent 130 also helps to direct the bypass flow back toward the filter. The upper forward corner could include a curved or chamfered component 174 as well. The front wall structure also provides an exterior chamfered and/or curved transition surface 174 that promotes a horizontal velocity component in the replacement air flow proximate the lower edge of the hood. This flow arrangement therefore tends to push the thermal plume rearward toward the filter unit 106. In some embodiments, such as in a hood structure having a height H of between 24 and 30 inches and a depth D of between 42 and 72 inches, a radius or chamfer 128 of at least 3" (e.g., between 4" and 8") plus a flat 130 having a depthwise length of at least 3" (e.g., between 4" to 8") has been found to be effective for accelerating and directing the plume back towards the filters by inducing a flow from the front edge of the hood where it is weakest, farthest from the filters, and presenting the return flow back into the effluent stream. This shape will also allow the air to follow the surface and generate a directional flow into the hood rather than downward. A downward flow past a 90 degree hood edge, as typically used in the prior art per FIG. 1, can create a low pressure zone at the front lower edge tending to pull effluent out of the hood. The return arrangement formed by portions 128 and 130 also serves to partially close down the opening of the bottom of the hood increasing velocities into the hood aperture while still allowing a large hood canopy volume for capture of bypass flows. An upwardly angled lip 131 is located at the end of flat 130. The lip preferably has is at least 1" in length and may extend at an angle that is at least forty-five degrees relative to horizontal (e.g., sixty degrees). The lip structure aids in holding grease within the hood and also aids in producing a pressure drop that tends to pull air flow off of the front edge of the hood.

Figure 5:
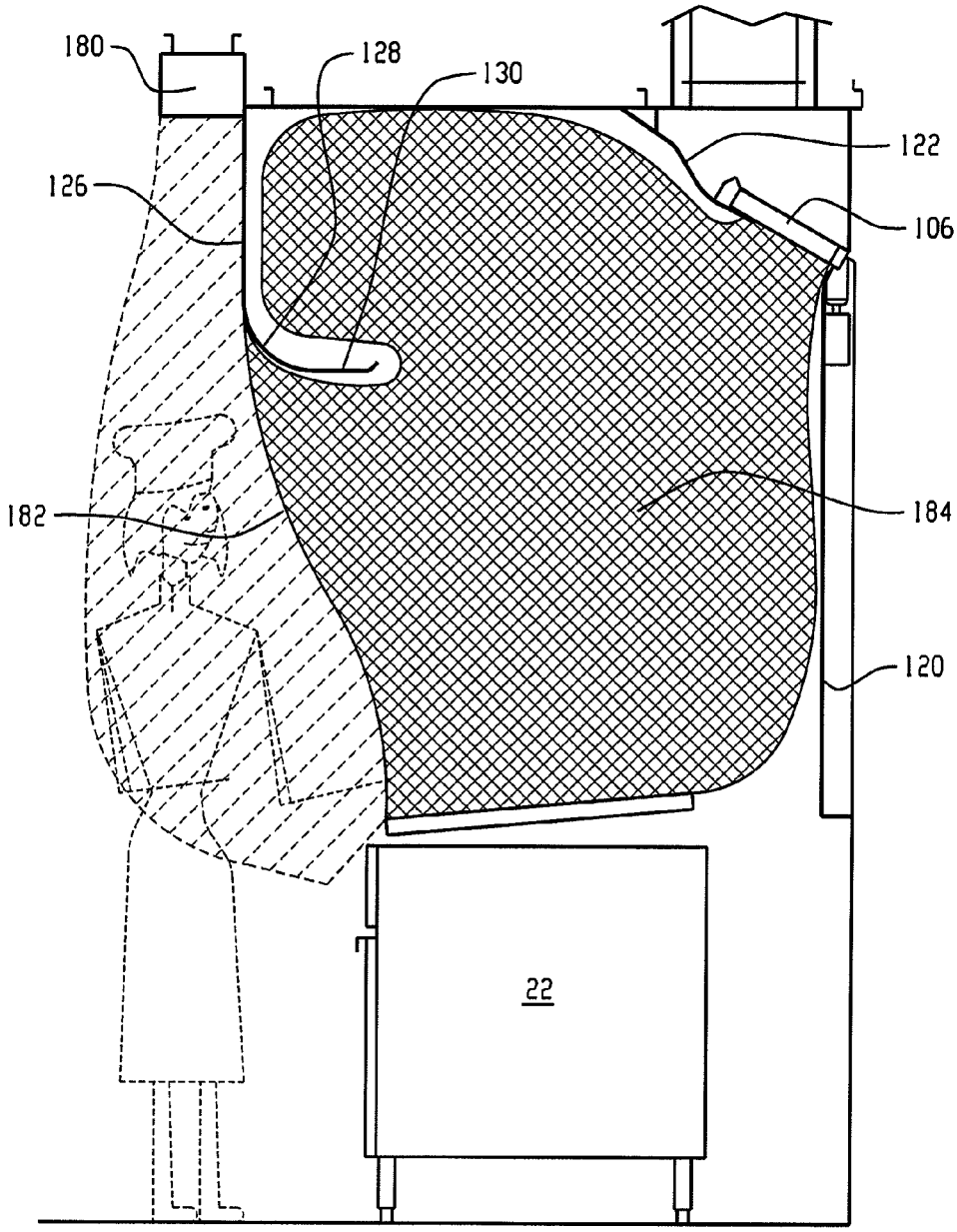
FIGS. 5 and 6 are side elevations of another embodiment of an exhaust hood system that includes a front diffuser.
Figure 6:
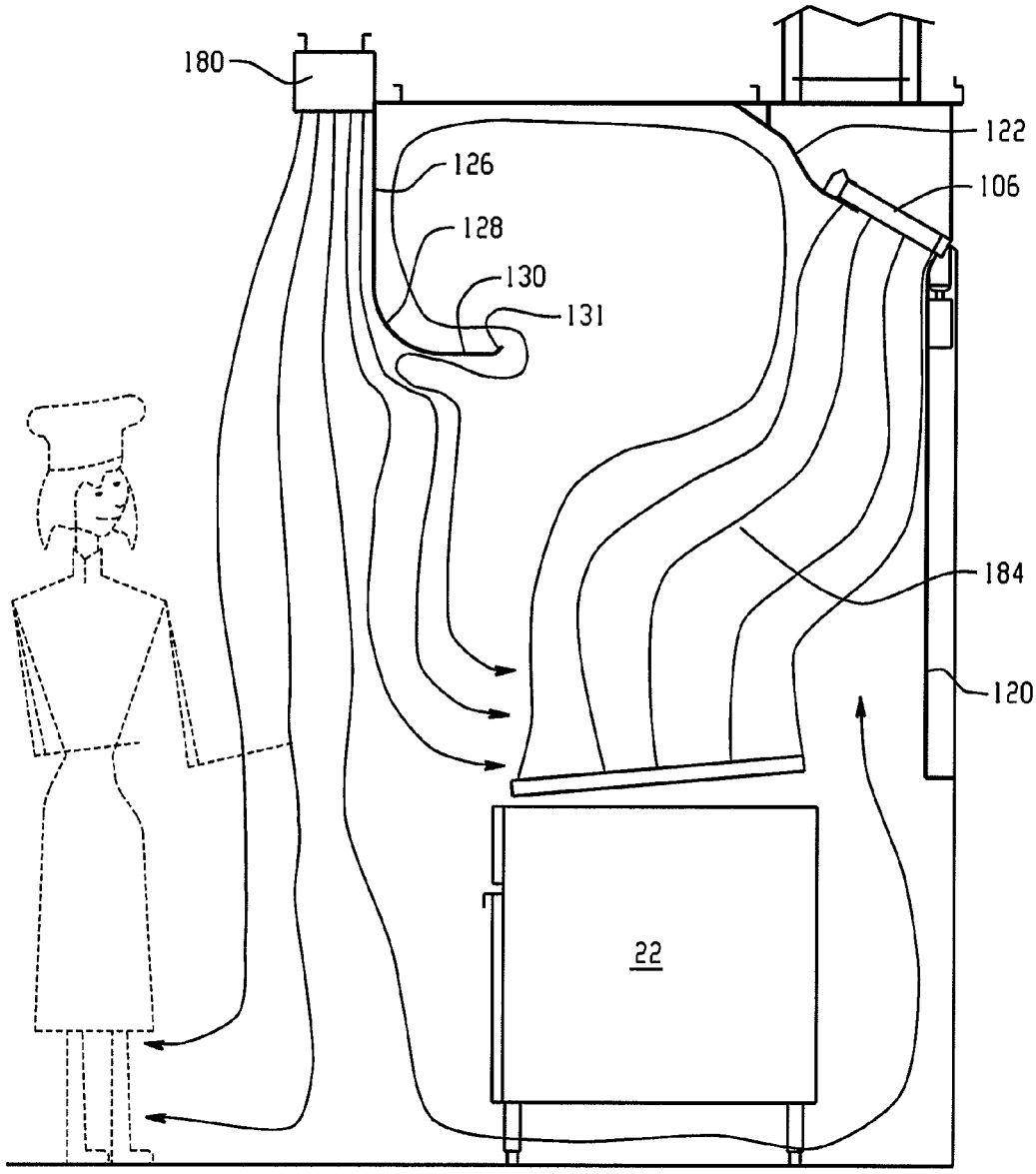

Referring now to FIGS. 5 and 6, an alternative embodiment of a commercial cooking equipment exhaust system is similar to that of FIGS. 2-4, but incorporates the use of a diffuser 180 that outputs a replacement air flow downward at the front of the hood. FIG. 5 is a thermal representation and FIG. 6 is an air flow representation. The replacement air flow helps maintain a thermal boundary 182 to aid in keeping the thermal plume 184 beneath the hood and out of the work area of cooking personnel. The thermal boundary 182 is generally a turbulent boundary with a temperature gradient across some distance rather than the ideal line of demarcation shown in FIG. 5. The curve or chamfer at the front edge of the hood applies an inward pressure at the front edge area that helps contain the plume. In a preferred implementation, the diffuser feeds in replacement air at a velocity of between 75 and 150 feet per minute and at a volumetric flow rate of between 30 and 90 cubic feet per minute per linear foot of diffuser width, where the diffuser width is measured along the front of the hood structure (i.e., into the page in FIG. 5). The inflow of air via the diffuser 180 may be set at a volume that is between about 25% and 35% of the volume of air that passes through the hood. The thermal boundary effect will be most effective when replacement air output by the diffuser has a temperature that is lower than an ambient temperature of the location at which the exhaust system is installed (e.g., at least one degree lower). In order to achieve this result the replacement air may, for example, be drawn from a conditioned space of the building that is in a different location (e.g., a different room, such as a dining area) than the exhaust system. Controlled dampening of tempered air could also be used. Air removed from the exhaust system location (e.g., the kitchen) for this effect would preferably be taken from the ground level where temperatures are cooler, or even ducted in from areas inside the building where the temperature are less than the kitchen ambient. The application of the diffuser at ambient or below temperature, and being run at controlled velocity and volumetric flow, will also starve the middle of the hood for replacement air which it will get from the sides of the hood strengthening them as well in the process.

Figure 7:
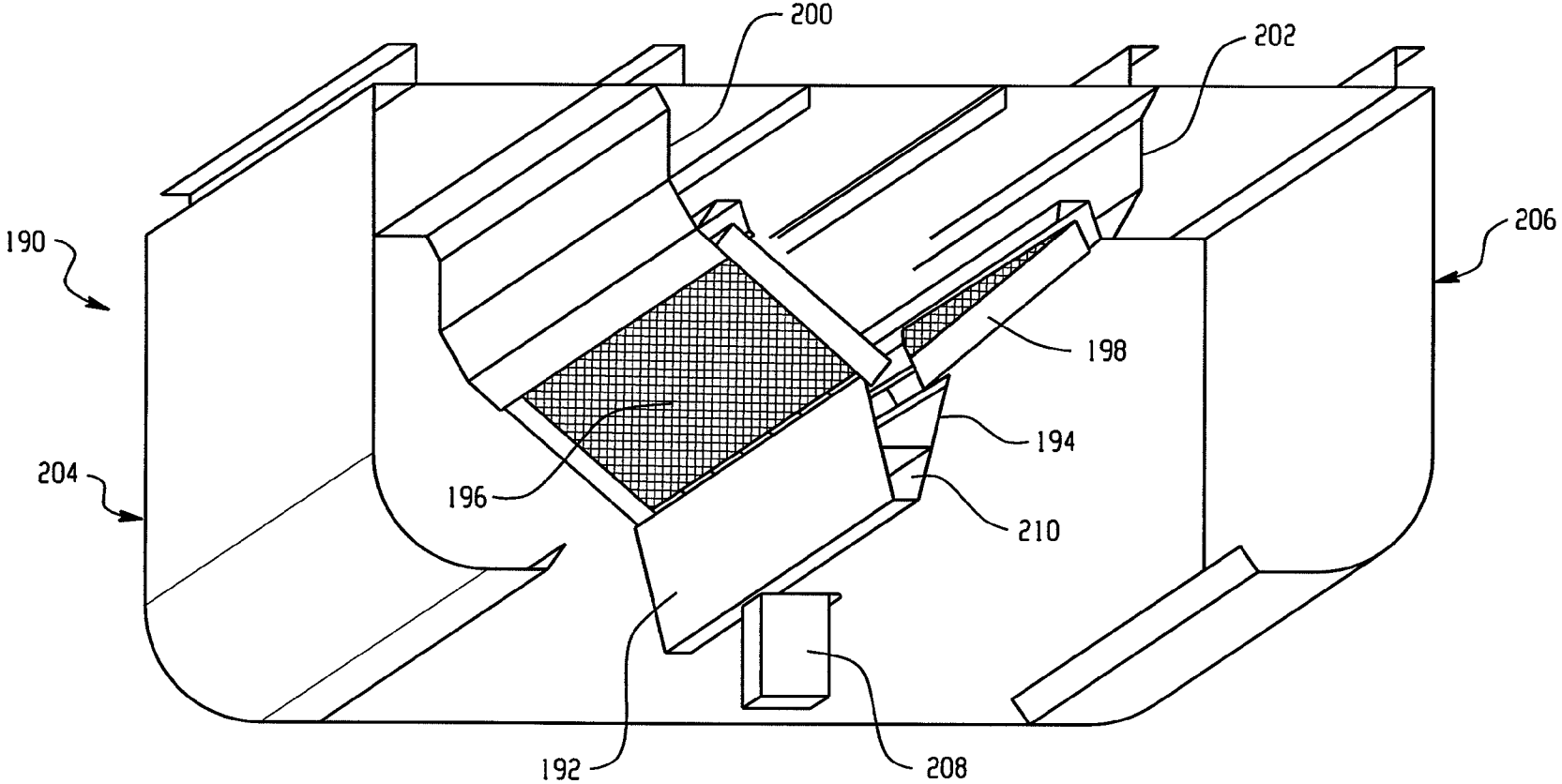
FIG. 7 is a perspective view of an island hood structure embodiment.

A further embodiment of an exhaust system, in the form of a two-sided island hood structure 190, is shown in FIG. 7. Separate exhaust flow infeed surfaces 192 and 194 feed separate filter units 196 and 198, and bypass transition surfaces 200 and 202 (e.g., which may be shaped as described above) are provided at the upper side of each filter unit. The illustrated surfaces 192 and 194 are fully contained within the height of the hood. In this arrangement, each wall structure 204 and 206 represents a front wall structure (e.g., relative to the location of the corresponding filter unit) and each front wall structure includes downward, transitional and rearward portions similar to those described above. A hanging grease capture bucket/container 208 to receive grease from the grease gutter 210. In preferred arrangements the container 208 is located at least two feet from the lateral edge of the hood structure.

Figure 8:
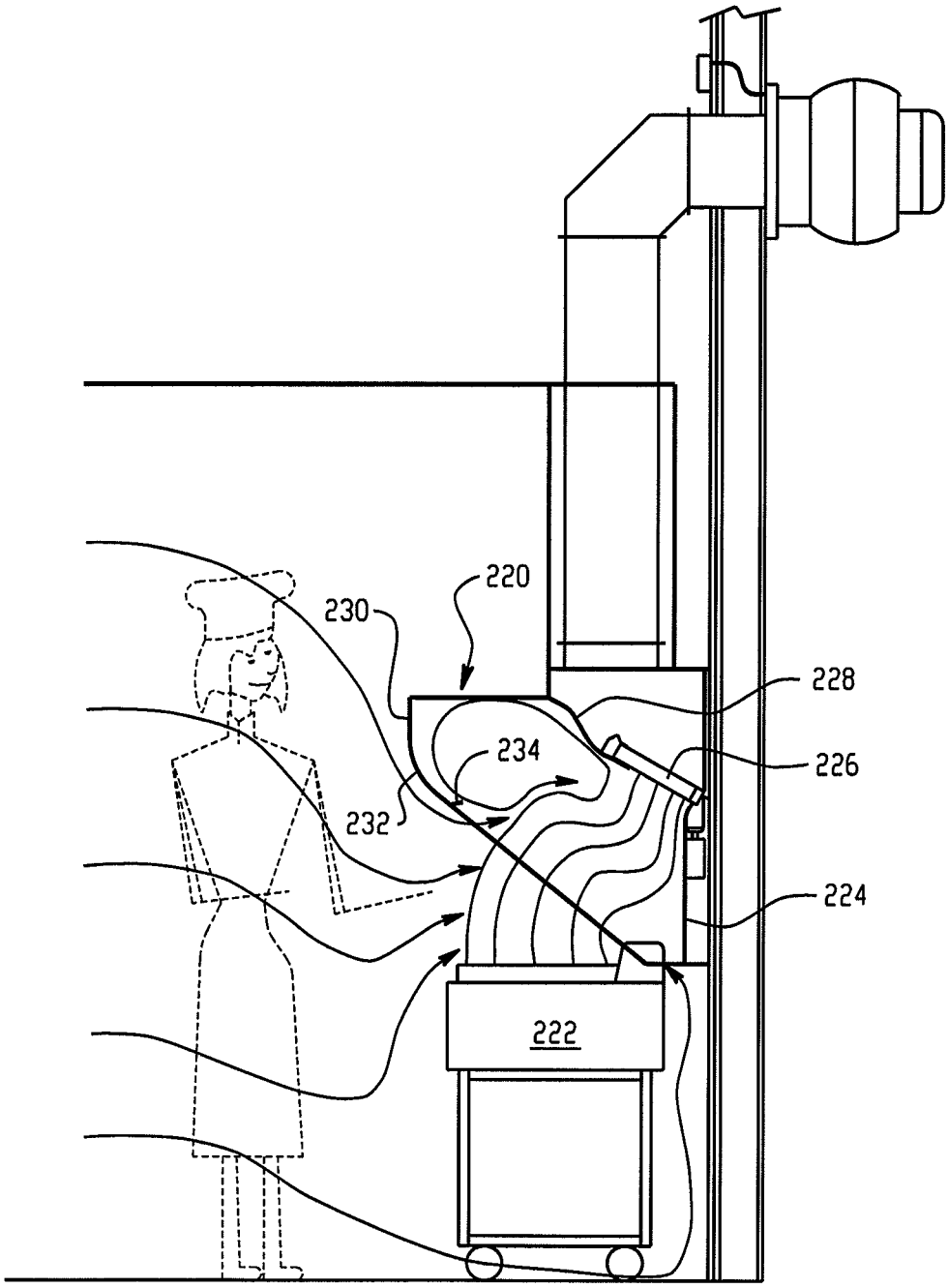
FIG. 8 is a side elevation of an embodiment of a back shelf style hood.

Referring now to FIG. 8, a back shelf hood embodiment is shown in which the hood structure 220 is located at a lower elevation from the cooking equipment 222. A rear exhaust flow infeed surface 224 is provided and is arranged to restrict flow up behind the equipment it draws more replacement air from the front. The illustrated surface 224 terminates proximate the cooking surface (e.g., between 32 and 44 inches above the floor). As the plume rises its short distance it is pulled back toward the infeed surface 224 and the filters 226 where it is removed allowing a small residual or bypass flow to be accelerated by transition surface 228 (similar to transition surface 122), and then swirl back into the incoming replacement air stream. The front edge of the hood structure includes a vertical wall portion 230, a chamfer or curved portion 232 and a lip structure 234 that in combination promotes a flow of replacement air back toward the filter aperture while also closing down the hood aperture increasing the relative entrance velocities. In this arrangement, no horizontal leg is provided, such that the rearwardly extending structure angles downwardly. However, in an alternative arrangement the front edge could include a horizontal extent such as segment 130 of the above embodiments.

Although the invention has been described and illustrated in detail it is to be clearly understood that the same is intended by way of illustration and example only and is not intended to be taken by way of limitation. It is recognized that numerous other variations exist, including both narrowing and broadening variations of the appended claims.

What is claimed is:

1. A commercial cooking equipment exhaust system for exhausting thermal plume produced by cooking operations, comprising:

a hood structure including a downwardly facing inlet opening, a filter aperture positioned within the hood structure with a filter unit positioned therein, the hood structure having a rear side mounted along a building wall;

a commercial cooking appliance located below the hood structure and having a cooking surface;

a substantially vertical exhaust flow infeed surface extending from a height proximate the cooking surface and upward through the downwardly facing inlet opening of the hood structure toward the filter unit, the substantially vertical exhaust flow infeed surface located forward of the building wall by at least three inches and positioned to pinch off and reduce flow area for air to travel upward behind the commercial cooking appliance so as to enhance the tendency of thermal plume to attach to and travel upward along the substantially vertical exhaust flow infeed surface and into the hood structure toward the filter unit, where a space behind the substantially vertical exhaust flow infeed surface is not used for flow of air back into the kitchen, and the substantially vertical exhaust flow infeed surface is positioned forward of a lower end of the filter unit so that thermal plume gases traveling upward along the substantially vertical exhaust flow infeed surface are directed into a face of the filter unit.

2. The commercial cooking equipment exhaust system of claim 1 wherein the hood structure includes a front wall structure with an interior surface portion that is arranged to turn bypass flows within the hood structure back toward the filter unit.

3. A commercial cooking equipment exhaust system for exhausting thermal plume produced by cooking operations, comprising:

a hood structure including a downwardly facing inlet opening, a filter aperture positioned within the hood structure with a filter unit positioned therein, the hood structure having a rear side mounted along a wall;

a commercial cooking appliance located below the hood structure and having a cooking surface;

a substantially vertical exhaust flow infeed surface extending from a height proximate the cooking surface and upward through the downwardly facing inlet opening of the hood structure to a location aligned with the filter unit, the substantially vertical exhaust flow infeed surface located forward of the wall by at least three inches so as to pinch off and reduce flow area for air to travel upward behind the commercial cooking appliance thereby enhancing the tendency of thermal plume to attach to and travel upward along the substantially vertical exhaust flow infeed surface and into the hood structure toward the filter unit, where a space behind the substantially vertical exhaust flow infeed surface is not used for flow of air back into the kitchen, and the substantially vertical exhaust flow infeed surface is positioned so that thermal plume gases traveling upward along the substantially vertical exhaust flow infeed surface are directed into a face of the filter unit without required change of direction within the hood structure.

4. The commercial cooking equipment exhaust system of claim 3 wherein the substantially vertical exhaust flow infeed surface is formed by the forward wall of a box-like structure formed of sheet metal that is enclosed at the sides and the bottom, the bottom positioned at a height proximate the cooking surface.

5. A method of directing thermal plume flow into a kitchen exhaust system, where the kitchen exhaust system includes a hood structure having a downwardly facing inlet opening, a filter unit positioned within the hood structure and a rear side of the hood structure mounted along a building wall, the method comprising:

providing a substantially vertical exhaust flow infeed surface that extends downward from a location within the hood structure proximate a lower portion of the filter unit and to a height proximate a cooking location below the hood structure, the substantially vertical exhaust flow infeed surface located forward of the rear side of the hood structure, where a space behind the substantially vertical exhaust flow infeed surface is not used for flow of air back into the kitchen;

locating a cooking appliance in the cooking location with a rear side of the cooking appliance positioned near the substantially vertical exhaust flow infeed surface to pinch off and reduce flow area for air to travel upward into the plume along the rear side of the commercial cooking appliance so as the enhance the tendency of the thermal plume to attach to and travel upward along the substantially vertical exhaust flow infeed surface and into the hood structure;

wherein the substantially vertical exhaust flow infeed surface is positioned so that thermal plume gases travelling upward along the exhaust flow infeed surface are directed into a face of the filter unit.

* * * * *